US010919088B2

(12) United States Patent
Rydholm et al.

(10) Patent No.: US 10,919,088 B2
(45) Date of Patent: Feb. 16, 2021

(54) METHOD AND STIRRING SYSTEM FOR CONTROLLING AN ELECTROMAGNETIC STIRRER

(71) Applicants: ABB SCHWEIZ AG, Baden (CH); ArcelorMittal, Luxembourg (LU)

(72) Inventors: Bengt Rydholm, Västerås (SE); Fredrik Sandberg, Västerås (SE); Hongliang Yang, Västerås (SE); Jan-Erik Eriksson, Västerås (SE); Jean-Marie Galpin, Montigny-les-Metz (FR); Bruno Langlet, Dunkirk (FR); Jean-Luc Curé, Metz (FR); Nicolas Triolet, Wormhout (FR); Thierry Lecoester, Dunkirk (FR)

(73) Assignees: ABB Schweiz AG, Baden (CH); ArcelorMittal, Luxembourg (LU)

( * ) Notice: Subject to any disclaimer, the term of this patent is extended or adjusted under 35 U.S.C. 154(b) by 0 days.

(21) Appl. No.: 16/482,585

(22) PCT Filed: Jan. 23, 2018

(86) PCT No.: PCT/EP2018/051537
§ 371 (c)(1),
(2) Date: Jul. 31, 2019

(87) PCT Pub. No.: WO2018/149594
PCT Pub. Date: Aug. 23, 2018

(65) Prior Publication Data

US 2020/0188994 A1 Jun. 18, 2020

(30) Foreign Application Priority Data

Feb. 20, 2017 (EP) ..... 17156938

(51) Int. Cl.
*B22D 41/62* (2006.01)
*B22D 11/115* (2006.01)
(Continued)

(52) U.S. Cl.
CPC ..... *B22D 41/62* (2013.01); *B22D 11/115* (2013.01); *B22D 11/18* (2013.01); *B22D 41/186* (2013.01); *B22D 41/58* (2013.01)

(58) Field of Classification Search
CPC ..... B22D 11/115; B22D 11/18; B22D 41/50; B22D 41/58; B22D 41/62; B22D 11/10; B22D 41/186
(Continued)

(56) References Cited

U.S. PATENT DOCUMENTS 5,074,532 A 12/1991 Ducrocq et al.
5,186,886 A 2/1993 Zerinvary et al.
(Continued)

FOREIGN PATENT DOCUMENTS

CN 100357049 C 12/2007
CN 102847892 A 1/2013
(Continued)

OTHER PUBLICATIONS

Machine translation of KR 2010-00222287 A (dated Mar. 2, 2010).*
Russian Decision on Grant with Translation Application No. 2019129519/02(058112) Completed: Mar. 25, 2020 11 pages.
Russian Search Report Application No. 2019129519/02(058112) Completed: Feb. 11, 2020 2 pages.
(Continued)

*Primary Examiner* — Kevin P Kerns
(74) *Attorney, Agent, or Firm* — Whitmyer IP Group LLC

(57) ABSTRACT

A method of controlling an electromagnetic stirrer arranged around a submerged entry nozzle (SEN) of a tundish provided with a stopper rod to control throughput of the tundish, the SEN being configured to provide tapping of molten metal from the tundish and the electromagnetic stirrer being configured to generate a rotating magnetic field in the SEN, wherein the method includes controlling the electromagnetic
(Continued)

stirrer to operate only when a gas flow rate through the stopper rod is in a first range of 1.5 NL/min to 20 NL/min.

18 Claims, 1 Drawing Sheet

(51) Int. Cl.
*B22D 11/18* (2006.01)
*B22D 41/18* (2006.01)
*B22D 41/58* (2006.01)

(58) Field of Classification Search
USPC ..... 164/466, 468, 502, 504, 453, 488, 155.1
See application file for complete search history.

(56) References Cited

U.S. PATENT DOCUMENTS

| | | | |
|---|---|---|---|
| 7,669,638 | B2 | 3/2010 | Kollberg et al. |
| 2006/0124272 | A1 | 6/2006 | Galpin et al. |
| 2015/0352635 | A1 | 12/2015 | Eriksson et al. |

FOREIGN PATENT DOCUMENTS

| | | | |
|---|---|---|---|
| CN | 203917905 | U | 11/2014 |
| CN | 105772666 | A | 7/2016 |
| JP | H07108355 | A | 4/1995 |
| JP | 08150448 | A | 6/1996 |
| JP | 08229670 | A | 9/1996 |
| JP | H09164462 | A | 6/1997 |
| JP | H09277034 | A | 10/1997 |
| JP | 09295109 | A | 11/1997 |
| JP | 10109153 | A | 4/1998 |
| JP | 2002103009 | A | 4/2002 |
| JP | 2010240687 | A | 10/2010 |
| JP | 2011079060 | A | 4/2011 |
| KR | 20100022287 | A | 3/2010 |
| KR | 20150002095 | A | 1/2015 |
| RU | 2457064 | C1 | 7/2012 |
| WO | 2004050277 | A1 | 6/2004 |
| WO | 2005042183 | A1 | 5/2005 |

OTHER PUBLICATIONS

Christer Carlsson et al: "Melhoramento na qualidade e productividade no Iingotamento de placa III por vibracao e parada electromagnetica/Improved quality and productivity in slab casting by electromagnetic braking and stirring", Tecnologia Em Metalurgia, Materials E Minerca 41st Steelmaking Seminar—International; May 23-26, 2010, Aman—Academia Militar Das Agulhas Negras—Resende, RJ, Brazil, Associacao Brasileira De Metalurgia, Materials E Mineracao, Sao Paul, vol. 8, Jan. 1.

Dewei, Li et al: "Effects of Electromagnetic Swirling Flow in Submerged ENtry Nozzle on Square Billet Continuous Casting of Steel Process", vol. 53, No. 7, 2013, XP002772813.

Extended European Search Report Application No. 17156938.7 Completed: Aug. 8, 2017; dated Aug. 21, 2017 10 Pages.

International Search Report & Written Opinion of the International Searching Authority Application No. PCT/EP2018/051537 Completed Date Mar. 1, 2018; dated Mar. 13, 2018 16 Pages.

N. Terzija et al: "Use of electromagnetic induction tomography for monitoring liquid metal/gas flow regimes on a model of an industrial steel caster", Measurement Science and technology, vol. 22, 2011, XP002772812, pp. 2-8.

Timmel K. et al: "Experimental and numerical modelling of the fluid flow in the continuous casting of steel", European Physical Journal. Special Topics, The, Springer, DE, FR, vol. 220, No. 1, Mar. 26, 2013, pp. 151-166, XP035364444, ISSN: 1951-6355.

Japanese Ofthce Action and Translation Application No. 2019-544925 Completed Feb. 4, 2020 4 pages.

Korean Office Action Translation Application No. 20197025996 Completed: Jan. 15, 2020; dated Jan. 22, 2020 8 pages.

Canadian Office Action (2nd) Application No. 3,054,094 dated Jun. 11, 2020 3 pages.

European Office Action Application No. 18 703 231.3-1108 dated Jun. 15, 2020 4 pages.

Korean Office Action with Translation Application No. 10-2019-7025996 dated May 29, 2020 8 pages.

Japanese Office Action with Translation Application No. 2019-544925 dated Jun. 23, 2020 4 pages.

Chinese Office Action; Application No. 201880011304.4; dated Aug. 14, 2020; 18 Pages.

* cited by examiner

METHOD AND STIRRING SYSTEM FOR CONTROLLING AN ELECTROMAGNETIC STIRRER

TECHNICAL FIELD

The present disclosure generally relates to metal making and in particular to a method and a stirring system for controlling an electromagnetic stirrer.

BACKGROUND

Submerged Entry Nozzles (SEN) are used for controlling the flow pattern in a slab caster mold, and consequently for the slab and final product quality. It is a common practice to purge argon gas into the SEN for the purpose of avoiding nozzle clogging due to oxides building up on the SEN inner wall and for controlling the flow pattern in the mold.

With higher demand on product quality, several problems with conventional SENs have been identified and a swirling flow nozzle has been considered as one effective measure in improving the flow in the mold and thus to improve the product quality.

Electromagnetic stirring of molten metal flowing through the tundish nozzle has been under development for the last twenty years. The principle of an electromagnetic stirrer arranged around the nozzle, is to generate a rotating magnetic field in the nozzle. Eddy currents are thereby induced in the molten metal flowing through the nozzle. This gives rise to an electromagnetic force that rotates the molten metal horizontally in the SEN.

CN 100357049C discloses an electromagnetic swirl nozzle. An electromagnetic swirl means is provided on a moving mechanism around the nozzle, which moving mechanism is movable from the casting position.

SUMMARY

Although stirring by means of a rotating/traveling magnetic field in an SEN may have beneficial effects on the end product, the present inventors have realized that even if electromagnetic stirring is used to provide stirring in an SEN, a number of additional parameters should be fulfilled in order to be able to provide the desired higher quality end product.

In view of the above, an object of the present disclosure is to provide a method of controlling an electromagnetic stirrer provided around an SEN which solves, or at least mitigates, the problems of the prior art.

There is hence according to a first aspect of the present disclosure provided a method of controlling an electromagnetic stirrer arranged around a submerged entry nozzle (SEN) of a tundish provided with a stopper rod to control throughput of the tundish, the SEN being configured to provide tapping of molten metal from the tundish and the electromagnetic stirrer being configured to generate a rotating magnetic field in the SEN, wherein the method comprises: controlling the electromagnetic stirrer to operate only when a gas flow rate through the stopper rod is in a first range of 1.5 NL/min to 20 NL/min.

The inventors have found that by controlling the electromagnetic stirrer to operate only when the gas flow rate is 1.5 NL/min or higher, a more efficient electromagnetic stirring may be provided than for lower gas flow rates. Furthermore, the inventors have found that operation of the electromagnetic stirrer in combination with a higher gas flow rate than 20 NL/min can generate a gas plug in the SEN, which could be harmful for the flow in the mold and to the product quality. Thus, by only operating the electromagnetic stirrer when the gas flow rate is in the first range, optimal stirring in the SEN may be provided, ensuring, if all other is equal, a higher quality end product.

With NL/min is meant normal liters per minute. With the term "operate" is here meant that the electromagnetic stirrer is configured to provide a rotating magnetic field only when the gas flow rate through the stopper rod is in the specified first range. The electromagnetic stirrer has coils which are energized to provide this rotating magnetic field, and thus, when electromagnetic stirrer is operated the coils are energized, thereby creating a rotating magnetic field. The coils are typically not energized when the electromagnetic stirrer is not being operated, at least not so that they will create a rotating magnetic field in the molten metal.

According to one embodiment the first range is 2 NL/min to 15 NL/min. The range of 2 NL/min to 15 NL/min has proved to be especially advantageous in being able to provide a higher quality end product.

According to one embodiment, in addition to the gas flow through the stopper rod being in the first range, the controlling involves controlling the electromagnetic stirrer to operate only when the casting throughput is at least 1.5 ton/min. The inventors have found that if electromagnetic stirring is applied when the throughput is less than 1.5 ton/min coalescence of the gas bubbles may be promoted generating a gas plug in the SEN, which could be harmful for the flow in the mold and for the product quality.

According to one embodiment the controlling involves controlling the electromagnetic stirrer to operate only when the casting throughput is at least 1.8 ton/min.

One embodiment comprises, prior to the step of controlling, obtaining a gas flow rate through the stopper rod, wherein the controlling is based on the obtained gas flow rate.

According to one embodiment the controlling of the electromagnetic stirrer involves providing a controlled sub-meniscus speed of molten metal in a mold in a second range of 0.20 m/s to 0.50 m/s.

According to one embodiment the second range is 0.25 m/s to 0.45 m/s.

One embodiment comprises obtaining a sub-meniscus speed of molten metal in the mold, wherein the controlling is based on the obtained sub-meniscus speed.

According to one embodiment the gas is argon gas.

There is according to a second aspect of the present disclosure provided a stirring system for a metal-making process, comprising: an electromagnetic stirrer configured to be arranged around a submerged entry nozzle (SEN) of a tundish provided with a stopper rod to control throughput of the tundish, and a control system configured to control the electromagnetic stirrer to operate only when a gas flow rate through the stopper rod is in a first range of 1.5 NL/min to 20 NL/min.

According to one embodiment the first range is 2 NL/min to 15 NL/min.

According to one embodiment, in addition to the gas flow through the stopper rod being in the first range, the control system is configured to control the electromagnetic stirrer to operate only when the casting throughput is at least 1.5 ton/min.

According to one embodiment the control system is configured to control the electromagnetic stirrer to operate only when the casting throughput is at least 1.8 ton/min.

According to one embodiment the control system is configured to control the electromagnetic stirrer to provide a controlled sub-meniscus speed of molten metal in a mold in a second range of 0.20 m/s to 0.50 m/s.

According to one embodiment the second range is 0.25 m/s to 0.45 m/s.

One embodiment comprises a power source configured to power the electromagnetic stirrer, wherein the control system is configured to control the power source to thereby control the electromagnetic stirrer.

One embodiment comprises a sensor configured to measure a sub-meniscus speed of molten metal in a mold into which the SEN is configured to be lowered, wherein the control system is configured to control the power source based on a sub-meniscus speed measured by the sensor.

According to one embodiment the sensor comprises a ceramic rod configured to be immersed in molten metal, the sensor being configured to measure a torque on the ceramic rod, wherein the control system is configured to control the power source based on the torque.

Generally, all terms used in the claims are to be interpreted according to their ordinary meaning in the technical field, unless explicitly defined otherwise herein. All references to "a/an/the element, apparatus, component, means, etc." are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The present disclosure relates to a method of controlling an electromagnetic stirrer by means of a control system. The method is for use in a metal-making process, typically a continuous casting process, for example a steel-making process, an aluminum-making process, a lead-making process or a metal-alloy making process. The method may be configured to be used with a billet caster, a bloom caster or a slab caster.

The electromagnetic stirrer is of a type that is configured to be arranged around a submerged entry nozzle (SEN) of a tundish. The electromagnetic stirrer is hence configured to provide stirring of molten metal flowing through the SEN. The electromagnetic stirrer is thus of a type which extends circumferentially around the SEN.

The tundish comprises the SEN and a stopper rod, which has an axial channel through which a gas is able to flow to control the casting throughput of the tundish. The gas is typically argon gas.

The method involves controlling the electromagnetic stirrer by means of the control system so that the electromagnetic stirrer is only in operation when the gas flow rate through the stopper rod is in a first range of 1.5 NL/min to 20 NL/min. The first range may for example be 2 NL/min to 15 NL/min. To this end, the control system is configured to control the electromagnetic stirrer so that it generates a rotating magnetic field in the molten metal flowing through the SEN only when the gas flow rate through the stopper rod is in the first range.

Figure 1:
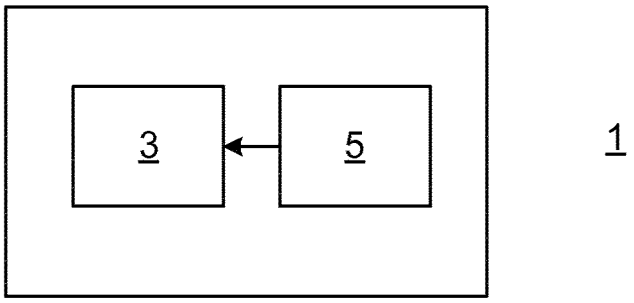
FIG. 1 schematically shows a block diagram of a control system.

With reference to FIG. 1, an example of a control system configured to control an electromagnetic stirrer will now be described. The exemplified control system 1 comprises processing circuitry 3 and a storage medium 5 comprising computer-executable components which when executed by the processing circuitry 3 causes the control system 1 to perform the method as disclosed herein.

The processing circuitry 3 uses any combination of one or more of a suitable central processing unit (CPU), multiprocessor, microcontroller, digital signal processor (DSP), application specific integrated circuit (ASIC), field programmable gate arrays (FPGA) etc., capable of executing any herein disclosed operations concerning the control of an electromagnetic stirrer.

The storage medium 5 may for example be embodied as a memory, such as a random access memory (RAM), a read-only memory (ROM), an erasable programmable read-only memory (EPROM), or an electrically erasable programmable read-only memory (EEPROM) and more particularly as a non-volatile storage medium of a device in an external memory such as a USB (Universal Serial Bus) memory or a Flash memory, such as a compact Flash memory.

Figure 2:
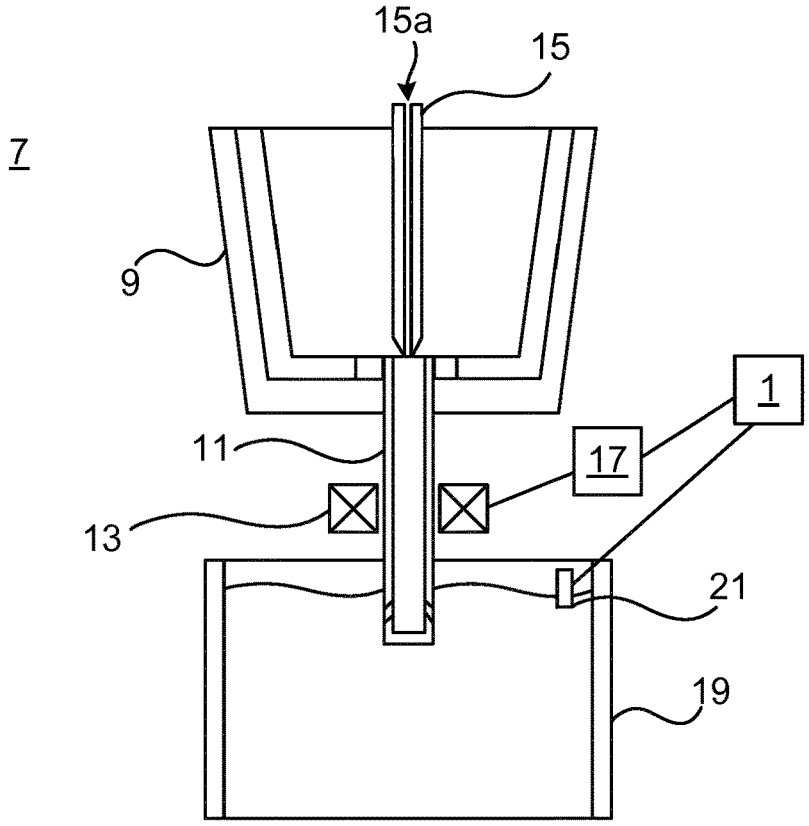
FIG. 2 schematically shows an assembly for metal-making including the control system in FIG. 1.

FIG. 2 shows an example of an environment in which the control system 1 operates when controlling an electromagnetic stirrer. Assembly 7 is used in a metal-making process and comprises a tundish 9, which is a metallurgical vessel provided with a bottom tapping hole, an SEN 11 configured to provide tapping of molten metal from the tundish 9, in particular via the bottom tapping hole, and a stopper rod 15. The SEN 11 may be monolithic or non-monolithic.

The assembly 7 also includes a stirring system comprising an electromagnetic stirrer 13 configured to be mounted around the SEN 11 and the control system 1. The stirring system also includes a power source 17 which is configured to power the electromagnetic stirrer 13. The power source 17 may for example be a power converter, such as an AC/AC converter or a DC/AC converter. The control system 1 is configured to control the power source 17 to thereby control the electromagnetic stirrer 13. In this manner, the rotating magnetic field applied to the SEN 11 may be controlled. The electromagnetic force that rotates the molten metal flowing through the SEN 11 may hence be controlled.

The electromagnetic stirrer 13 may be configured to be fixedly mounted relative to the tundish and relative to the SEN or it may be movably mounted relative to the SEN. In the former case, the electromagnetic stirrer is configured to be mounted immovably relative to the tundish and the SEN. In particular, the electromagnetic stirrer is in this case configured to be mounted to a fixed structure, which is fixed relative to the tundish and relative to the SEN. This fixed structure may for example be the tundish itself, for example the tundish bottom, an SEN-cutting device mounted to the tundish bottom, or a locking device, typically configured to attach and lock two longitudinally extending nozzle parts of an SEN together.

The electromagnetic stirrer 13 may be a closed-type electromagnetic stirrer, in the sense that it has no moving parts in the portion surrounding the SEN 11. The electromagnetic stirrer 13 may have a closed and integral SEN-enclosing portion, or annular end portion configured to surround the SEN 11. According to this example, the electromagnetic stirrer 13 is non-openable. The annular end portion is thus integrated, although it should be understood that the annular end portion may comprise a number of distinct components, such as a magnetic core and coils wound around the core. The annular end portion forms a channel configured to receive the SEN 11. This channel may be said to be seamless in the circumferential direction, along the inner circumference of the channel. In case the electromagnetic stirrer 13 is of a closed type, the electromagnetic stirrer 13 cannot during installation be opened and placed around the SEN 11 from two sides of the SEN 11, before closing. Instead, during installation, the electromagnetic stirrer 13 is threaded over the SEN 11 in the axial direction thereof. The SEN-enclosing portion provides a circumferentially closed and integral annular passage through which the SEN is configured to extend. The closed and integrated SEN-enclosing portion has no moving parts, which prolongs the lifetime of the electromagnetic stirrer. Compared to open-type electromagnetic stirrers, a higher magnetic field strength may be obtained, and magnetic leakage may be reduced.

According to another variation, the electromagnetic stirrer 13 may be openable. The electromagnetic stirrer 13 may in this case have an SEN-enclosing portion which is openable. The SEN-enclosing portion may for example be hinged, or the electromagnetic stirrer 13 may comprise two separable halves which may be placed around the SEN 11, wherein the halves are assembled with each other.

In use of the assembly 7, molten metal is tapped into the tundish 9 from a ladle. The flow of molten metal discharged from the tundish may be controlled through the SEN 11, typically by means of the stopper rod 15. The stopper rod 15 has a gas inlet and a gas outlet, connected by means of a channel 15*a* extending in the longitudinal direction to enable a gas to flow from the gas inlet through the stopper rod 15 to the gas outlet, and into the SEN 11 which is arranged aligned with but downstream of the stopper rod 15. The flow of molten metal may thus be controlled in the SEN 11 to avoid nozzle clogging. The stopper rod 15 is additionally configured to be moved vertically up and down to regulate the flow-rate of the molten metal flowing from the tundish 9 to the mold 19 via the SEN 11.

Below the tundish 9 there is provided a mold 19 into which the SEN 11 extends and from which molten metal is discharged into the mold 19. The molten metal is partially solidified in the mold 19. The partially solidified metal is then moved by gravity from the mold 19, normally through an arrangement of rollers for shaping and for cooling. In this manner, billets, blooms or slabs may be obtained.

Figure 3:
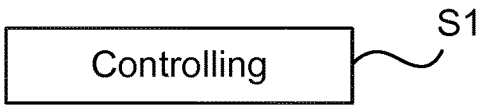
FIG. 3 shows a flowchart of a method of controlling an electromagnetic stirrer by means of the control system in FIG. 1.

Referring to FIG. 3, the operation of the control system 1 will now be described. In a step S1 the electromagnetic stirrer 13 is controlled to operate only when the gas flow rate through the stopper rod 15 is in a first range of 1.5 NL/min to 20 NL/min, the first range preferably being between 2 NL/min and 15 NL/min. As noted above, this control is provided by the control system 1.

During casting, the gas flow rate is beneficially controlled to be higher than 1.5 NL/min, preferably at least 2 NL/min in order to obtain an improved mold flow due to the provision of electromagnetic stirring in the SEN. The gas flow rate is beneficially controlled to be lower than 20 NL/min, preferably not higher than 15 NL/min. A higher gas flow rate than 20 NL/min in combination with electromagnetic stirring in the SEN may generate a gas plug in the SEN, which could be harmful for the flow in the mold and for the product quality. The gas flow rate may be controlled by means of the control system 1 or by another controller dedicated to control the gas flow rate through the stopper rod 15.

The control system 1 may be configured to obtain a gas flow rate of the gas flowing through the stopper rod before step S1. The gas flow rate may for example be obtained from measurements by one or more gas flow rate sensor(s) and/or by means of estimation. The step S1 of controlling is then based on the obtained gas flow rate.

Moreover, step S1 may involve an additional constraint, namely that of a minimum casting throughput of 1.5 ton/min, preferably 1.8 ton/min. Hereto, the control system 1 may be configured to control the electromagnetic stirrer 13 to operate only when the gas flow rate through the stopper rod 15 is in the first range and when the casting throughput is at least 1.5 ton/min, preferably at least 1.8 ton/min.

Applying electromagnetic stirring on the SEN 11 with throughput less than 1.8 ton/min can promote coalescence of the gas bubbles and generate a gas plug in the SEN 11 which could be harmful for the flow in the mold and for the product quality.

According to one example, step S1 of controlling the electromagnetic stirrer 13 may involve providing a controlled sub-meniscus speed of molten metal in a mold in a second range of 0.20 m/s to 0.50 m/s, the second range preferably being between 0.25 m/s and 0.45 m/s. In particular, the control target of the electromagnetic stirrer 13 may be to reach a double roll metal flow pattern in the mold and a controlled sub-meniscus speed in the second range. Hereto, the control system 1 may be configured to control the electromagnetic stirrer 13, by means of the power source 17 to reach this control target.

The stirring system may also include a sensor 21. The sensor 21 is configured to provide online measurements of casting parameters, typically of a sub-meniscus speed or velocity. The sensor 21 may be configured to measure a sub-meniscus speed of molten metal in the mold 19. The control system 1 may be configured to control the power source 17, and thus the electromagnetic stirrer 13, based on the sub-meniscus speed measured by the sensor 21 to attain a desired setpoint value of the sub-meniscus speed.

The sensor 21 may for example include a ceramic rod configured to be submerged in molten metal in the mold 19. The sensor 21 may be configured to measure the torque applied to the ceramic rod. The torque provides a measure of the sub-meniscus speed. The control system 1 may be configured to evaluate a torque measured by the sensor 21 and to convert it to a sub-meniscus speed. The control system 1 may be configured to control the power source 17 based on the sub-meniscus speed obtained.

As an alternative to the above-described torque measurement, the wave height of the meniscus may be measured, and the control system 1 may be configured to evaluate the wave height to obtain an estimate of the sub-meniscus speed.

As yet another alternative, the metal throughput may be measured online, or the metal throughput and the argon gas flow through the stopper rod 15 may be measured or estimated and used as basis for controlling the electromagnetic stirrer 13 by means of the control system 1.

According to one example, the control system 1 is configured to control the power source 17 so that the electromagnetic stirrer 13 provides a rotating magnetic field which generates an electromagnetic force in the molten metal which rotates the molten metal at least one turn, typically more than one turn, as it flows from one end of the SEN 11 to the other end of the SEN 11, in the longitudinal direction of the SEN 11.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A method of controlling an electromagnetic stirrer arranged around a submerged entry nozzle (SEN) of a tundish provided with a stopper rod to control a casting throughput of the tundish, the SEN being configured to provide tapping of molten metal from the tundish and the electromagnetic stirrer being configured to generate a rotating magnetic field in the SEN, wherein the method comprises:

controlling the electromagnetic stirrer to operate only when a gas flow rate through the stopper rod is in a first range of 1.5 NL/min to 20 NL/min.

2. The method as claimed in claim 1, wherein the first range is 2 NL/min to 15 NL/min.

3. The method as claimed in claim 2, wherein in addition to the gas flow rate through the stopper rod being in the first range, the controlling involves controlling the electromagnetic stirrer to operate only when the casting throughput is at least 1.5 ton/min.

4. The method as claimed in claim 2, comprising, prior to the step of controlling, obtaining a gas flow rate through the stopper rod, wherein the controlling is based on the obtained gas flow rate.

5. The method as claimed in claim 2, wherein the controlling of the electromagnetic stirrer involves providing a controlled sub-meniscus speed of molten metal in a mold in a second range of 0.20 m/s to 0.50 m/s.

6. The method as claimed in claim 1, wherein in addition to the gas flow rate through the stopper rod being in the first range, the controlling involves controlling the electromagnetic stirrer to operate only when the casting throughput is at least 1.5 ton/min.

7. The method as claimed in claim 6, wherein the controlling involves controlling the electromagnetic stirrer to operate only when the casting throughput is at least 1.8 ton/min.

8. The method as claimed in claim 1, comprising, prior to the step of controlling, obtaining a gas flow rate through the stopper rod, wherein the controlling is based on the obtained gas flow rate.

9. The method as claimed in claim 1, comprising obtaining a sub-meniscus speed of molten metal in a mold, wherein the controlling is based on the obtained sub-meniscus speed.

10. The method as claimed in claim 9, wherein the controlling of the electromagnetic stirrer involves providing a controlled sub-meniscus speed of molten metal in the mold in a second range of 0.20 m/s to 0.50 m/s.

11. The method as claimed in claim 10, wherein the second range is 0.25 m/s to 0.45 m/s.

12. The method as claimed in claim 1, wherein argon gas flows through the stopper rod.

13. A stirring system for a metal-making process, comprising:

an electromagnetic stirrer configured to be arranged around a submerged entry nozzle (SEN) of a tundish provided with a stopper rod to control a casting throughput of the tundish, and a control system configured to control the electromagnetic stirrer to operate only when a gas flow rate through the stopper rod is in a first range of 1.5 NL/min to 20 NL/min.

14. The stirring system as claimed in 10, wherein the first range is 2 NL/min to 15 NL/min.

15. The stirring system as claimed in claim 13, wherein in addition to the gas flow rate through the stopper rod being in the first range, the control system is configured to control the electromagnetic stirrer to operate only when the casting throughput is at least 1.5 ton/min.

16. The stirring system as claimed in claim 15, wherein the control system is configured to control the electromagnetic stirrer to operate only when the casting throughput is at least 1.8 ton/min.

17. The stirring system as claimed in claim 13, wherein the control system is configured to control the electromagnetic stirrer to provide a controlled sub-meniscus speed of molten metal in a mold in a second range of 0.20 m/s to 0.50 m/s.

18. The stirring system as claimed in claim 17, wherein the second range is 0.25 m/s to 0.45 m/s.

* * * * *